United States Patent [19]

Curiel

[11] Patent Number: 4,945,708

[45] Date of Patent: Aug. 7, 1990

[54] METHOD OF MAKING A TAMPER RESISTANT PACKAGE

[75] Inventor: Yoram Curiel, Aurora, Colo.

[73] Assignee: TSL Incorporated, Aurora, Colo.

[21] Appl. No.: 386,884

[22] Filed: Jul. 31, 1989

Related U.S. Application Data

[60] Division of Ser. No. 209,822, Jun. 22, 1988, Pat. No. 4,890,763, and a continuation-in-part of Ser. No. 6,756, Jan. 27, 1987, abandoned, which is a continuation-in-part of Ser. No. 891,517, Jul. 29, 1986, abandoned.

[51] Int. Cl.[5] ..... B65B 61/18; B65B 61/26; B65D 53/06

[52] U.S. Cl. ..... 53/411; 53/141; 206/459; 206/524.3; 206/534; 206/605; 206/807; 215/230; 215/233; 220/457; 427/7; 427/54.1; 427/411; 428/916

[58] Field of Search ..... 53/131, 133, 411, 412, 53/442, 449, 508; 116/205, 206; 206/459, 484, 524.3, 534, 531, 532, 605, 623, 538, 627, 807; 215/122, 230, 233, 246, 250, DIG. 6; 220/359, 455–457; 427/7, 54.1, 411; 428/209, 916

[56] References Cited

U.S. PATENT DOCUMENTS

| | | | |
|---|---|---|---|
| 1,664,635 | 4/1928 | Magill . | |
| 2,074,490 | 3/1937 | Schwartz . | |
| 2,127,548 | 8/1938 | Boyle et al. . | |
| 3,415,402 | 12/1968 | Webber | 215/31 X |
| 3,662,915 | 5/1972 | Destler, Jr. . | |
| 3,783,089 | 1/1974 | Hurst et al. . | |
| 3,786,777 | 1/1974 | Smith et al. . | |
| 3,935,960 | 2/1976 | Cornell . | |
| 4,098,577 | 7/1978 | Halpern | 206/459 X |
| 4,181,223 | 1/1980 | Millet . | |
| 4,424,252 | 1/1984 | Nativi . | |
| 4,436,203 | 3/1984 | Reyner . | |
| 4,449,632 | 5/1984 | Marusiak, Jr. . | |
| 4,451,523 | 5/1984 | Nativi et al. . | |
| 4,479,585 | 10/1984 | Sandhaus . | |
| 4,502,605 | 3/1985 | Wloszczyna . | |
| 4,505,399 | 3/1985 | Weiner . | |
| 4,516,679 | 5/1985 | Simpson et al. . | |
| 4,526,752 | 7/1985 | Perlman et al. | 427/7 X |
| 4,546,881 | 10/1985 | Tasma . | |
| 4,718,553 | 1/1988 | Adamoli et al. . | |
| 4,759,445 | 7/1988 | McVay . | |
| 4,838,425 | 6/1989 | O'Brien et al. | 206/807 X |

*Primary Examiner*—Robert L. Spruill
*Assistant Examiner*—Beth Bianca
*Attorney, Agent, or Firm*—Arnold B. Silverman

[57] ABSTRACT

The invention provides a package and associated method for packaging of products which enhances the resistance to tampering with or adulteration of the product, and which also permits a readily visible indication that any such tampering or adulteration has occurred. The invention in one form provides an inner container which is in turn provided with an outer protective layer of epoxide resin. The outer layer is cured and it becomes extremely brittle such that any physical penetration of the outer layer will cause the entire outer layer to shatter. Such shattering will provide a clear indication that penetration of the protective layer has occurred. Also there may be provided an associated dye which will exhibit a color change when the outer protective layer is shattered. A warning message may be provided on said packaging underlying the outer layer. Use of the brittle material in a blister package is contemplated with or without an underlying packaging layer and other uses of the brittle material without support are contemplated.

24 Claims, 3 Drawing Sheets

METHOD OF MAKING A TAMPER RESISTANT PACKAGE

CROSS REFERENCE TO RELATED APPLICATIONS

This is a division of application Ser. No. 209,822 filed 6/22/88, now U.S. Pat. No. 4,890,763 and a continuation-in-part of United States application Ser. No. 07/006,756 filed Jan. 27, 1987 now abandoned which in turn was a continuation-in-part of U.S. Ser. No. 06/891,517 filed July 29, 1986 now abandoned.

BACKGROUND OF THE INVENTION

1. Field Of The Invention

This invention relates to tamperproof packaging and, more specifically, it relates to a tamper resistant package and a method of sealing packages such that a clear indication would be given if any tampering occurs and more specifically the invention relates to a product which is coated with a layer of extremely brittle material that cannot be unsealed without completely shattering the packaging. Also provided is one embodiment of the present invention wherein part or all of the packaging is comprised of an extremely brittle material such that the packaging itself cannot be unsealed without completely shattering the packaging material.

2. Description Of The Prior Art

The tampering with and adulteration of many commercially available products has become a critical problem endangering health and sanitation. Many products which are adulterated or tampered with ultimately reach a consumer beaming no indication that such adulteration or tampering has occurred. Accordingly, it is highly desirable to provide a type of packaging which would give an indication that there has been interference with the integrity of the product packaging.

Various mechanical indications used to determine the integrity of several types of products and containers have been known. For example, U.S. Pat. No. 3,662,915 relates to a tamperproof package which provides a recessed tab in the inner periphery of a container which breaks away from the remainder of the container when entry is made into the container so as to indicate that tampering with the package has occurred.

It has been known to employ elastomeric materials disposed in protective surrounding relationship with respect to a container. See U.S. Pat. Nos. 4,546,881, 4,449,632, and 4,181,223.

U.S. Pat. No. 2,074,490 discloses a tamperproof container in the form of a tinplate container having a composite coating consisting of a heat sensitive paint, printing ink, and varnish. This coating is said to distort responsive to any effort to remove the can end, get access to the contents, and then solder the end to the can.

It has been known to provide for rupturing of outer coatings which fracture responsive to operation of a tear strip. See U.S. Pat. No. 3,415,402. See so U.S. Pat. No. 4,479,585.

It has been known to protect printed circuit boards by ultraviolet curable polymeric coatings which are intimately bonded to such boards. See U.S. Pat. Nos. 4,451,523 and 4,424,252.

In addition to such mechanical indicators, it has been known to provide a color indication that package integrity has been interrupted. For example, U.S. Pat. No. 3,935,960 provides a hermetically sealed container having a tape closure over an aperture for removing the contents of the container. The tape closure is provided with an indicator layer of color capsules which rupture when the tape closure is removed.

U.S. Pat. No. 4,502,605 provides an indicator dye/activator system which is mounted on the cap of a container in such a way that opening the cap of the container causes the indicator material to oxidize and thereby change in color. It teaches the use of a volatile alkali solution such as ammonia as an activator having a pH in the range of 9–12 whereas atmospheric air has a pH in the range of 5–7. The preferred indicator dye is said to be phenolphthalein or other dyes sensitive to changes in the pH. See also U.S. Pat. No. 4,516,679.

U.S. Pat. No. 4,098,577 also discloses use of a pH sensitive dye which will display a different color when in contact with atmospheric air which would occur when the package is opened. U.S. Pat. No. 4,505,399 provides a sheet of material sensitive to light or oxygen which would effect a time-delayed, irreversible change in appearance in response to exposure. The sensitive material would be placed between two inactive sheets and the combination would be placed over the opening to the container so that the sensitive sheet would have to be exposed when the container is opened.

Some of the problems which have been encountered in using the prior art techniques are that they can be circumvented by various means. In addition, the known methods are primarily confined to use with certain types and configurations of containers.

In spite of the existing prior art techniques, there remains a need for an effective method of indicating that a product has been tampered with or adulterated. There remains a need for such a method which is economical and easy to use with a wide range of package configurations.

SUMMARY OF THE INVENTION

The present invention has met the above-described need by providing a package which is tamper resistant in that it is provided with an exterior coating which is extremely brittle and which will shatter when any puncture of the coating occurs. Also provided is a method of packaging products which involves coating the container with a layer of extremely brittle material such that the container cannot be unsealed without completely and irreversibly shattering the material. Alternatively, another embodiment of the present invention would provide that one or more walls of the package to be used would be comprised of the extremely brittle material.

It is also contemplated that a moisture or oxygen sensitive dye may be placed under the chemical coating which would exhibit a distinctive change in coloration if anything has penetrated the layer of coating.

It is also contemplated in one embodiment that fracture of the brittle layer will expose an underlying warning.

It is an object of the invention to provide a package and method which will effectively and economically permit resistance to tampering and detection of any tampering with or adulteration of the packaging of presently commercially available products.

It is another object of the invention to provide a package and method for protecting against tampering for use with a variety of containers of different shapes, configurations, and materials without being limited to a particular package design.

It is a further object of the present invention to provide a method for easily determining the integrity of the package immediately upon observation of the package.

It is yet another object of the present invention to provide a method of packaging which is easy and economical to apply to the container.

It is a further object of the invention to provide a device which offers resistance against undetectable tampering with the package.

These and other objects of the invention will be more fully understood from the following description of the invention with reference to the illustrations appended hereto.

DESCRIPTION OF THE PREFERRED EMBODIMENT

Figure 1:
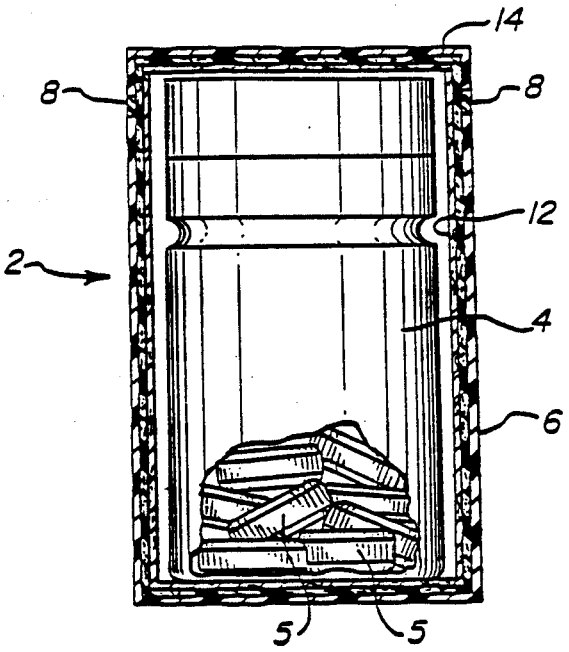
FIG. 1 illustrates a cross section of one embodiment of the device of the present invention wherein an outer package which holds an inner container is coated with the outer protective coating.

Tampering with and/or adulteration of food, drug, and medical products has become increasingly more common and the effects of such activities have become increasingly more dangerous to health and has in some instances have proved fatal. By providing packaging which readily exhibits to the naked eye the fact that a product has been tampered or interfered with, consumers can be put on notice and can avoid purchasing such products.

According to the device and method of the present invention, a package is provided, preferably exteriorly, with a layer of extremely brittle material, as by coating. Preferably, the coating material would be an epoxide resin such as a cycloaliphatic epoxide manufactured by Union Carbide Corp. of Danbury, Conn., and sold under the trade designation CYRACURE, UVR 6110. Alternatively, the coating material could be a polyester base ultraviolet cured matte sold under the trade designation Polycure by Oriental Intl. of Tokyo, Japan, for example. As another alternative, a premixed ultraviolet light curable cycloaliphatic epoxide may be used such as, for example, those sold under the trade designation Envibar UV 1244 manufactured by the Union Carbide Corp. of Danbury, Conn. Other materials of the Envibar line, such as K 231 and K 232 and also UV 1231, for example are suitable.

In order that the present invention be more fully understood some further details about the properties of the preferred materials will be given. In general, cycloaliphatic epoxide products such as those mentioned hereinbefore, are low-viscosity, miscible liquids that are easily combined. In order to obtain the appropriate properties with those materials, they must be combined with photoinitiators. The process of this combination is sometimes referred to as "formulation". A suitable class of materials are the onium salt photoinitiators. When onium salts are exposed to ultraviolet light they photolyze or chemically decompose under the action of light and generate a cationic species that acts as a catalyst and/or initiator for polymerization of cycloaliphatic epoxides. Suitable materials are those sold under the trade designations CYRA CURE EVI-6974 and CYRA CURE UVI-6990 by Union Carbide Corp. and UVE-1014 and UVE-1016 by General Electric Company. More specifically, the cationic chemistry involved in the curing of adhesives, coatings, inks, and sealants deals with onium salt photoinitiators. These photoinitiators are blocked catalysts that are unblocked by the action of ultraviolet light. When the salts are exposed to ultraviolet light, they photolyze and chemically decompose under the action of ultraviolet light. Subsequently, they generate into a cationic species that acts as a catalyst or an initiator for polymerization of cycloaliphatic epoxides. In the presence of the generated cationic species, very rapid polymerization takes place.

The specific material mentioned above, UVR 6110, is a general purpose base epoxide that has an excellent cure response and viscosity differentiation that facilitates formulation. As stated herein, the epoxide materials respond to ultraviolet light cure when they are combined with an appropriate photoinitiator. Aryldiazonium salts and arylidonium salts are suitable photoinitiators. When the base epoxides, such as UVR 6110, are used alone as the only polymerizing ingredient in a formulation, hard, brittle coatings with good solvent resistance and adhesion result. This result is desirable for purposes of the present invention.

If desired, a material containing the photoinitiator may be employed. One suitable material for this purpose is that sold by Union Carbide under the trade designation ENVIBAR 1244.

In order to prepare the formulation, the various ingredients may be simply combined or stirred by simple mixing for a suitable period, and then the coating and curing procedures are undertaken. The process should preferably be carried out under "yellow" light conditions to protect the preparation from ultraviolet light until curing is performed.

Some substances, such as the preferred material, Envibar UV 1244, discussed hereinbefore, are premixed such that the epoxide already contains the photoinitiators. Such one-step systems may be directly applied to the item to be protected and then cured. The coating which is preferably applied in generally uniform thickness may readily be accomplished by either dipping the product in the coating material or spraying the product with the desired coating material, for example. Alternatively, the material may be brushed onto the substrate. The layer of the appropriate liquid resin may be of any desired thickness depending upon the purpose for which it is to be used and the specific material to be used. For most purposes the thickness would, for example preferably be of a thickness between about 1.0 mil and 50 mil and is preferably between 1.0 and 15 mils when UVR 6110 or the like is used. When Envibar UV 1244 is used, the thickness would also preferably be between about 1.0 and 15 mils. As discussed hereinafter, the brittle packaging material may be used alone to package a product. When employed alone the thickness would be preferably between about 2.0 mils to 100 mils. The coating material is preferably applied to the entire package exterior, but may be applied solely to certain critical areas. One or more overlying layers of packaging material may be applied if desired.

In addition, a separation or release layer of silicon, tetra flouroethylene ("Teflon"), oily film, cellophane, or a thin nylon membrane, for example, may be applied to the package, if desired, to resist adherence of the molten epoxide to the underlying portion of the container to be protected.

After the layer of liquid resin is applied to the package, the layer is then cured. It may preferably be cured, for example, by subjecting the package to a band of radiant ultraviolet light, for example. This may preferably be accomplished by exposing the product to a suitable medium, such medium would preferably be medium pressure mercury vapor from a suitable mercury vapor lamp which is known in the art. Alternatively, other methods of curing the coating layer may be used. The ultraviolet radiation required is preferably of an intensity of about 175 watts and it would be sufficient to expose the product to this radiation for at least about two seconds per three square feet of material. Other materials may require a shorter period of radiation exposure. As discussed herein, when the coating material is cured with the ultraviolet light and added to the epoxide, photoinitiators cause the molten epoxide to crystallize and the molten epoxide becomes hard and brittle as a result. Accordingly, any tampering with a product contained in this packaging will cause the outer epoxide shell of the packaging to shatter, portions of the shattered shell will tend to separate from the package and may break into separate pieces.

EXAMPLES

In order to provide additional insight into the present invention, three examples will be considered:

EXAMPLE 1

A sample coating comprised of cycloaliphatic epoxide (medium viscosity) UVR 6110 was mixed with a suitable photoinitiator, CYRA CURE UVI-5974 in the weight ratio of 4% (9674) to about 96% (6110). The coating material at a temperature of 64° F.–80° F. was then applied by spraying the material in a continuous coating using a spray nozzle onto the exterior of a sample container. A layer of a thickness of 2 mil was applied. The container as coated was then cured using ultraviolet light from a medium pressure mercury vapor source of an intensity of 175 watts for about 6 seconds. This process achieved a coating of a uniform thickness and was of the desired brittleness which was sufficient to achieve the objects of the present invention.

EXAMPLE 2

An example of a process employing a premixed epoxide, such as Envibar UV 1244, will be considered. A blistered top portion of a package may be precast using Envibar UV 1244 at a temperature of about 80° F. The product, such as a pharmaceutical in capsule form was introduced into recesses in the blistered top. A sheet of brittle matte was bonded to the top with Envibar UV 1244 being provided thereon. The entire package was then cured employing a medium pressure vapor lamp for about 6 seconds to provide a tamperproof package.

EXAMPLE 3

A conventional commercial coating employed on individual cardboard cartons for tubes of medical ointments was tested. The coating applied in a conventional manner and commercial standard thickness including both ink and varnish had an overall thickness of about 0.1 to 0.2 mils. Puncturing the container with a sharp instrument failed to create any coating fracture which was observable by the naked eye. This test confirmed the effectiveness of the tamperproof material of the present invention over the tested conventional package.

The present invention also contemplates an optional additional indicator, if desired, which would involve use of a moisture or oxygen sensitive dye as an additional indicator of tampering. Such dye would be placed under the chemical coating layer. A preferred dye would be hydroscopic alkaline, such as hypo. When that is used, no color change would be present if the outer coating or the packaging has not been broken. However, once the packaging is broken, air or oxygen may penetrate into the interior packaging. Once this occurs a distinctive coloration change would occur and would be immediately and readily visible. It is contemplated that other types of dyes could be used within the bounds of the present invention. This color changing chemical would be an additional safety feature which would give a further indication that the product concerned had been subjected to tampering.

In addition to the aforementioned safety features, it is contemplated that a tear strip would be provided to facilitate proper opening of the package. A pre-formed tear strip which has been treated with the appropriate coating material and properly cured could be placed on the package to function as an opening mechanism and also as an indicator of any tampering as tampering with the tear strip will break the chemical seal and will fracture the coating and other overlying packaging material.

Figure 2:
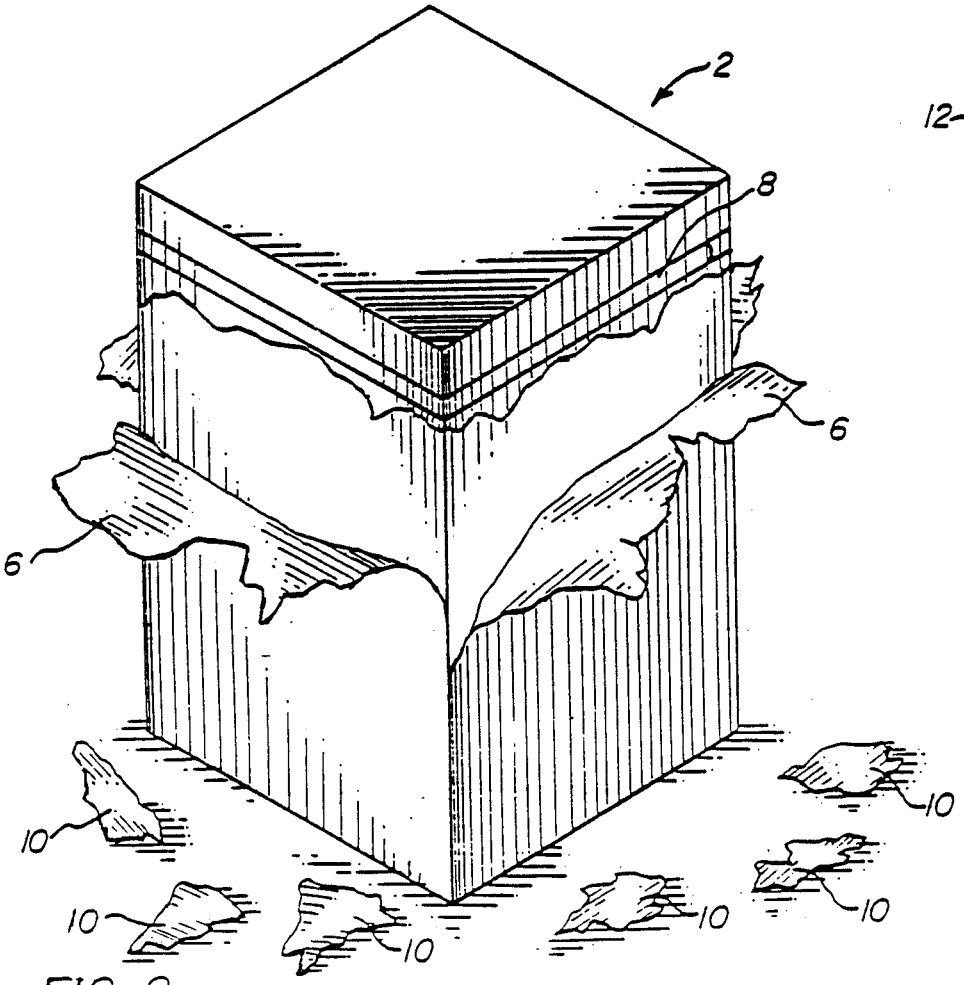
FIG. 2 illustrates a perspective view of one embodiment of the present invention after the outer coating has been shattered due to tampering or some other interference with package integrity.

Referring now more specifically to FIGS. 1 and 2, one preferred embodiment of the device of the present invention will be discussed. Package 2 holds inner container 4. The package 2 is preferably completely covered by outer protective layer 6. Outer layer 6 may be a cycloaliphatic epoxide as discussed hereinabove. Inner container 4 holds contents 5 which may be pharmaceutical products such as capsules or tablets, for example. Tear strip 8 is provided to facilitate ease of opening of the package. By simply pulling the tear strip 8, outer protective layer 6 is shattered. It will be appreciated that as the outer protective layer 6 overlies the tear strip 8, the tear strip cannot be operated without shattering the layer 6. This shattering without operation of tear strip 8 is illustrated in FIG. 2 where outer protective layer 6 is shattered into a plurality of individual pieces 10 by some form of physical penetration. Physical puncturing with a needle, or any attempt to open or interfere with package 2 results in fracture of layer 6. As noted above, a dye could also be used in addition to protective layer 6 to further enhance the likelihood that any product with which any tampering has occurred will be avoided.

As is shown in FIG. 2 when the outer protective layer 6 is shattered at least some portions thereof separate from the portion of the package 2 to which it had been secured. Some of such separated portions 10 may also separate from other portions of layer 10. In either event there is provided a tangible, readily visible indication of tampering. In lieu of having the message obscured by an opaque puncture layer 6, one may provide both the layer 6 and message of generally the same color which color contrasts with the underlying package component on which it appears.

Figure 3:
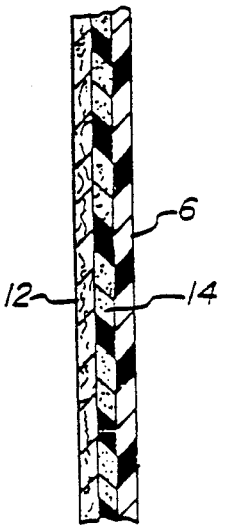
FIG. 3 illustrates a cross section of a portion of the side wall of a package according to one embodiment of the present invention.

FIG. 3 shows the sidewall of a package 2 in further detail. Package 2 has wall 12 which has outer protective layer 6 thereon. The indicator dye (not shown) could be placed between wall 12 and layer 6. One embodiment of the present invention may also include intermediate release layer 14 which keeps the molten epoxide from adhering to the sidewall 12 of package 2 in cases where such adherence of the epoxide resin could be undesirable.

Figure 4:
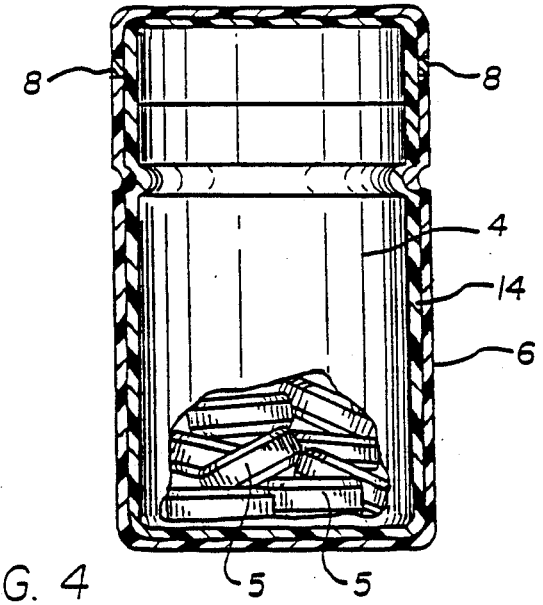
FIG. 4 illustrates a cross section of one embodiment of the present invention wherein the inner container of FIG. 1 is coated exteriorly with the outer protective coating.

The package 2 as shown in FIG. 1 is provided with the outer coating of the protective material. However, it is also contemplated and would be within the scope of the present invention that, as shown in FIG. 4 for example, a container, such as inner container 4, may be directly coated with or be composed entirely of the protective material with or without the use of an external container such as container 2.

If desired, an enhanced visual indication may b, provided by providing words or graphics or both as a warning indicator which would be visible only if tampering has occurred. For example, the words "IMPURE DO NOT USE" could be provided in a number of locations on the package 2 of FIG. 2 in positions underlying outer protective layer 6 such that layer 6 will conceal the message unless tampering has occurred. In FIG. 2 for example, the exposed portions of package 2 shows underlying tear strip 8 could contain such legends.

Figure 5:
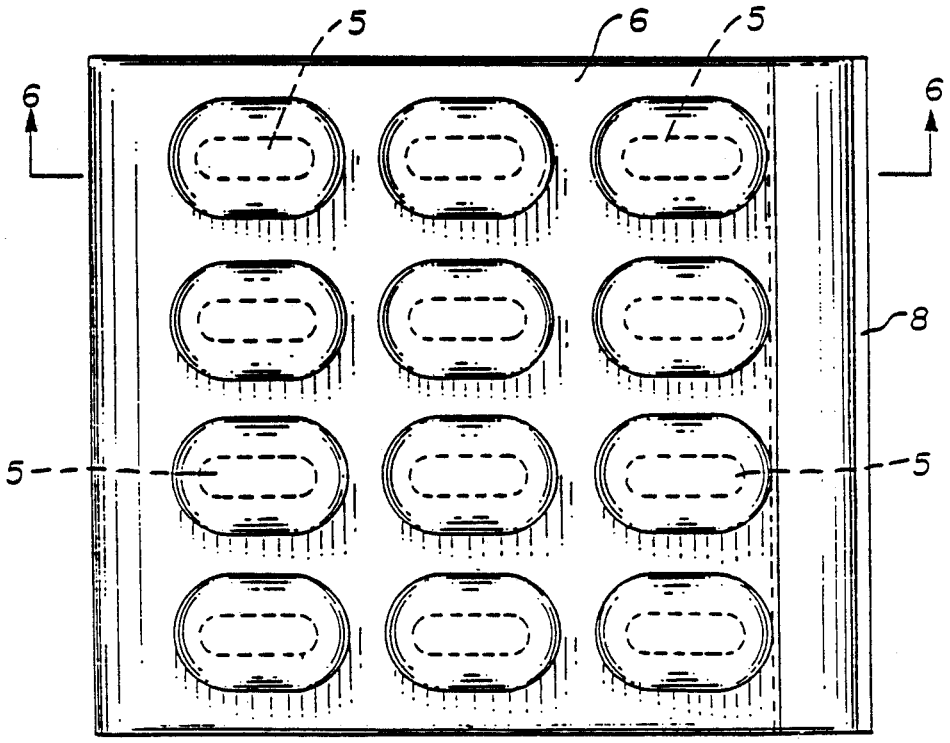
FIG. 5 illustrates a plan view of a blister package configuration of the present invention.
Figure 6:
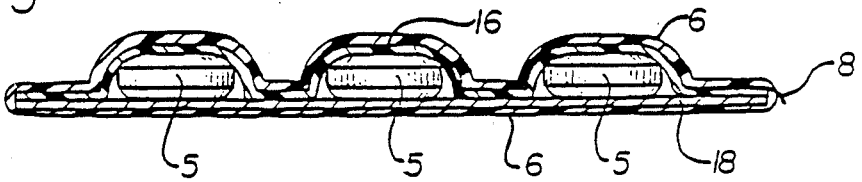
FIG. 6 illustrates a sectional view of the package along lines 6—6 of FIG. 5.

Alternatively, the outer coating 6 could be used, as shown in FIGS. 5 and 6, for example, with a "blister" packaging commonly used for packaging individual capsules or tablets. The blister packaging has first layer 16 and second layer 18. Sandwiched between first layer 16 and second layer 18 are tablets 5. A tear strip 8 may also be provided for ease of opening. This entire assembly is coated exteriorly with outer protective coating 6 and is then cured according to the present invention. When the tear strip is pulled, protective coating 6 shatters.

Figure 7:
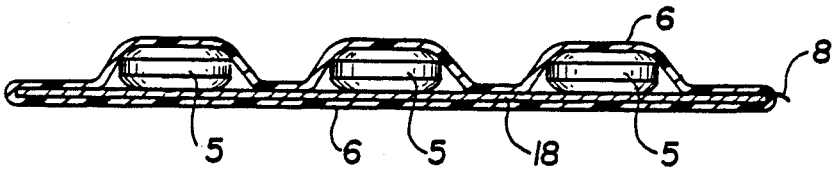
FIG. 7 illustrates a sectional view of a blister package configuration of the present invention, wherein the upper layer of the packaging is comprised of the outer coating material without a substrate material.

FIG. 7 depicts another embodiment of the present invention wherein the outer layer 6 is precast and comprises the upper layer or wall of the blister package without an underlying layer of packaging material. Second layer 18 is depicted in FIG. 7, but it is also contemplated to be within the scope of the present invention that layer 6 could be precast to form the entire packaging of the products without the need for a substrate such as layer 16 of FIG. 6 or layer 18 of FIGS. 6 and 7. Alternatively, the brittle layer could be used on the interior of an outer packaging such as cardboard or plastic for example within the bounds of the present invention.

As noted herein, the container to be packaged according to the present invention may contain pharmaceutical products. Alternatively, the packaging of the present invention could be used for a wide variety of products wherein package integrity is important. Examples of such other uses are medical instruments and other products which must remain sterile until opened and food products.

In a preferred embodiment of the invention in instances where the brittle material is adjacent to and bonded to a packaging component the bonding action will be sufficiently small that fracturing of the brittle material by tampering will tend to sever such bonds to facilitate separating of the brittle material from the package material. To the extent to which portions of such material which has separated from the package also separates from adjacent portions of the brittle material pieces, such as pieces 10 in FIG. 2 will fall off.

It will be appreciated that while for convenience of disclosure reference has been made herein to the cured material completely surrounding the product, it will be appreciated that in some instances a cooperating packaging component may be sufficiently impenetrable that the cured material will not be employed in the region of the package where such a packaging component is located.

In some uses, it will be desired to protect solely the portion of the package which is designed to be the point of entry or opening during normal usage.

It will be appreciated that in embodiments wherein the brittle layer is to be established by applying a layer to another packaging component this may readily be accomplished by any means such as spraying, brushing, or dipping.

It will further be appreciated, therefore, that the present invention provides a package and associated method for packaging products which provides an irreversible, ready indication that the package has been subjected to tampering or interference.

Whereas particular embodiments of the invention have been described above for purposes of illustration, :t will be appreciated by those skilled in the art that numerous variations of the details may be made without departing from the invention as described in the appended claims.

I claim:

1. A method of packaging a product comprising:

providing a container, applying to said container an exterior coating material to form a protective layer on the exterior of said container, and substantially curing said layer by applying ultraviolet radiation from a suitable source to establish a brittle layer, and said brittle layer being characterized by a propensity to irreversibly fracture and at least in part separate from said package in a plurality of pieces responsive to efforts to physically penetrate or open said package, whereby readily visible indicia of such tampering will be provided.

2. The packaging method of claim 1 including providing an indicator substance between the container and said layer, and said indicator substance exhibiting a first color under sealed conditions and exhibiting a second color when in contact with atmospheric air.

3. The packaging method of claim 1 including applying said layer to the container by coating.

4. The packaging method of claim 1 including applying said layer to the container by dipping the container in the coating material.

5. The packaging method of claim 1 wherein said coating material is a cycloaliphatic epoxide resin.

6. The packaging method of claim 1 including, employing a medium pressure mercury vapor lamp as the ultraviolet radiation source.

7. The packaging method of claim 2 wherein said source is a medium pressure mercury vapor lamp.

8. The packaging method of claim 7 wherein said mercury vapor is applied to said layer for at least 2 seconds.

9. The packaging method of claim 2 wherein said indicator dye is hygroscopic alkaline.

10. The packaging method of claim 2 wherein said indicator dye is oxygen sensitive.

11. The packaging method of claim 2 wherein said indicator dye is moisture sensitive.

12. The packaging method of claim 2 including providing a tear strip to cause shattering of said protective layer.

13. The packaging method of claim 1 wherein establishing said protective layer in a thickness of about 1.0 to 50 mils.

14. The packaging method of claim 13 including
providing warning markings on said package underlying said protective layer, and
said warning markings being provided so as to be not readily visible through said protective layer.

15. The packaging method of claim 14 including
establishing said protective layer in a thickness of about 1.0 to 15 mils.

16. A method of tamper resistant packaging a product comprising:
providing a product, and
at least partially surrounding said product with an ultraviolet cured brittle material,
said brittle material characterized by a propensity to irreversibly fracture and at least in part separate from other portions of said material in a plurality of pieces responsive to efforts to physically penetrate said material,
whereby efforts to penetrate said material will irreversibly fracture and fragment said material to provide evidence of tampering.

17. The method of claim 16 including effecting said curing while said material is in said surrounding position.

18. The method of claim 16 including prior to placing an additional packaging element around said product, surrounding said product with said material.

19. The method of claim 18 including securing said surrounding material to said additional packaging element.

20. The method of claim 16 including substantially completely surrounding said product with said material.

21. The method of packaging of claim 17 including in said protective material a curable cycloaliphatic epoxide resin.

22. The method of claim 17 including employing a medium pressure mercury vapor lamp as said ultraviolet radiation source.

23. The method of packaging of claim 16 including
establishing said brittle material in a thickness of about 2 to 100 mils.

24. The method of claim 19 including
said packaging element having a plurality of warning means disposed thereon and visible when said overlying surrounding material is removed therefrom.

* * * * *

UNITED STATES PATENT AND TRADEMARK OFFICE

CERTIFICATE OF CORRECTION

PATENT NO. : 4,945,708

DATED : August 7, 1990

INVENTOR(S) : YORAM CURIEL

It is certified that error appears in the above-identified patent and that said Letters Patent is hereby corrected as shown below:

Column 1, line 33, "beaming" should be --bearing--.

Column 1, line 58, "so" should be --also--.

Column 7, line 26, "b," should be --be--.

Claim 1, column 8, line 45, "substantially" should be --subsequently--.

Signed and Sealed this

Fifth Day of May, 1992

*Attest:*

*Attesting Officer*

DOUGLAS B. COMER

*Acting Commissioner of Patents and Trademarks*